US008719987B2

(12) United States Patent
Yan

(10) Patent No.: US 8,719,987 B2
(45) Date of Patent: May 13, 2014

(54) THIN-TYPE AUTOMATIC CLEANING DEVICE

(76) Inventor: Jason Yan, Tucheng (TW)

( * ) Notice: Subject to any disclaimer, the term of this patent is extended or adjusted under 35 U.S.C. 154(b) by 238 days.

(21) Appl. No.: 12/805,250

(22) Filed: Jul. 21, 2010

(65) Prior Publication Data

US 2011/0191976 A1 Aug. 11, 2011

(30) Foreign Application Priority Data

Feb. 11, 2010 (TW) ..... 99104425 A

(51) Int. Cl.

| | |
|---|---|
| ***A47L 3/00*** | (2006.01) |
| ***A47L 11/00*** | (2006.01) |
| ***A47L 23/00*** | (2006.01) |
| ***E04H 4/16*** | (2006.01) |
| ***B08B 7/00*** | (2006.01) |
| ***D06F 15/00*** | (2006.01) |
| ***D06F 37/00*** | (2006.01) |
| ***D06F 39/00*** | (2006.01) |

(52) U.S. Cl.
USPC ..... 15/3

(58) Field of Classification Search
USPC ..... 15/319, 327.2, 327.7, 340.1–340.4
IPC ..... A47L 5/00
See application file for complete search history.

(56) References Cited

U.S. PATENT DOCUMENTS

| | | | | |
|---|---|---|---|---|
| 5,513,417 | A * | 5/1996 | Kim et al. | 15/326 |
| 5,709,007 | A * | 1/1998 | Chiang | 15/329 |
| 2005/0015920 | A1 * | 1/2005 | Kim et al. | 15/352 |
| 2006/0196003 | A1 * | 9/2006 | Song et al. | 15/319 |
| 2006/0236492 | A1 * | 10/2006 | Sudo | 15/319 |
| 2006/0248676 | A1 * | 11/2006 | Baek | 15/319 |
| 2007/0039293 | A1 * | 2/2007 | Baek et al. | 55/354 |
| 2007/0130717 | A1 * | 6/2007 | Yan | 15/319 |
| 2008/0282494 | A1 * | 11/2008 | Won et al. | 15/319 |
| 2008/0282859 | A2 * | 11/2008 | Causse et al. | 83/76.3 |
| 2009/0100630 | A1 * | 4/2009 | Kim et al. | 15/319 |
| 2011/0126375 | A1 * | 6/2011 | Yan | 15/319 |
| 2012/0084935 | A1 * | 4/2012 | Chiu | 15/319 |

FOREIGN PATENT DOCUMENTS

| | | |
|---|---|---|
| JP | 2004-337495 | * 12/2004 |
| JP | 2006-334219 | * 12/2006 |
| KR | 10-2007-0018641 | * 2/2007 |

* cited by examiner

*Primary Examiner* — Rachel Steitz
*Assistant Examiner* — Jennifer Gill
(74) *Attorney, Agent, or Firm* — Bacon & Thomas, PLLC

(57) ABSTRACT

A thin-type automatic cleaning device includes a main body, a fan module and a dust collecting box. The main body includes a placing chamber for receiving the fan module. The dust collecting box has an outer surface with a shape corresponding to that of the placing chamber, and the dust collecting box is received within the placing chamber. The lower casing is provided with a receiving cavity from the bottom surface toward the interior of the dust collecting box to cover the fan module. The dust collecting box forms a nested structure with the fan module thereby to reduce the thickness of the device.

3 Claims, 7 Drawing Sheets

THIN-TYPE AUTOMATIC CLEANING DEVICE

FIELD OF INVENTION

The present invention relates to a cleaning device, and more particularly to a thin-type automatic cleaning device for automatically vacuuming the ground.

BACKGROUND

An automatic cleaning device is developed as a device that applies the technique of artificial intelligence, such as the technique of artificial intelligence robot. The automatic cleaning device is designed to have an artificial intelligence to vacuum the ground. All along with the introduction of cheaper automatic cleaning devices, people who use the device increase.

Recently, with the development of the automatic cleaning device, it is made thinner. However, each function module occupies a certain space, thus it limits the way to make the device thinner. In addition, a conventional fan of the automatic cleaning device is often required to be replaced for maintenance. However, the conventional structure of the automatic cleaning device causes the difficulty for the replacement. Moreover, when the fan is operated at a high speed by the children, it may harm the children by the rotating fan. Therefore, home safety is thus for consideration.

The inventor proposes an automatic cleaning device with a thinner structure to overcome the above drawbacks.

SUMMARY

The primary objective of the present invention is to provide a thin automatic cleaning device with a receiving cavity provided at the bottom surface of the dust collecting box. The receiving cavity is for accommodating a fan module. The dust collecting box forms a nested structure with the fan module. Thus the thickness of the device is effectively decreased so as to reduce the size of the device.

Another objective of the present invention is to provide a thin automatic cleaning device. A fan module is located on inner side of the bottom lid to simplify the maintenance of the fan module.

Yet another objective of the present invention is to provide a thin-type automatic cleaning device with a sealing sensing module for detecting whether or not the top lid is properly sealed before the activation of the moving module and the fan module. Thus, safety of the device is achieved.

In order to achieve above objectives, the present invention discloses a thin-type automatic cleaning device comprising a main body, a fan module and a dust collecting box. The main body includes a placing chamber; in which the fan module is accommodated. The dust collecting box has an outer surface with a shape corresponding to that of the placing chamber so as to be received within the placing chamber. The dust collecting box includes an upper casing and a lower casing that are engaged with each other. The bottom surface of the lower casing protrudes toward the interior of the dust collecting box so that a receiving cavity having a side wall is provided for covering the fan module. The top of the receiving cavity is provided with an air-vacuuming opening that accurately faces toward the fan module.

In one embodiment, the main body further includes a top lid and a bottom lid. The top lid is disposed on the top of the placing chamber, the bottom lid is disposed on the bottom of the placing chamber, and the fan module is disposed on the bottom lid.

In one embodiment, the thin-type automatic cleaning device further includes a control processing module, a moving module, a power switch and a sealing sensing module. The moving module, the power switch and the sealing sensing module are coupled to the control processing module. The power switch selectively switches the device between an on-state and an off-state by external operation. When the power switch is turned to the on state, the power switch transmits an activated signal to the control processing module to activate the moving module and the fan module. The sealing sensing module detects whether or not the top lid is sealed on the top of the placing chamber to transmit a first sensing signal to the control processing module. The control processing module determines whether or not to activate the moving module and the fan module according to the first sensing signal.

The above summary and following detailed description and drawings are used to describe the manner and the effect of the present invention. Other objectives and advantages are described in following description and drawings.

DETAILED DESCRIPTION

The present invention provides a thin-type automatic cleaning device which is characterized by providing a receiving cavity in a dust collecting box for accommodating a fan module. The dust collecting box forms a nested structure with the fan module so that the thickness of the device is reduced.

Figure 1:
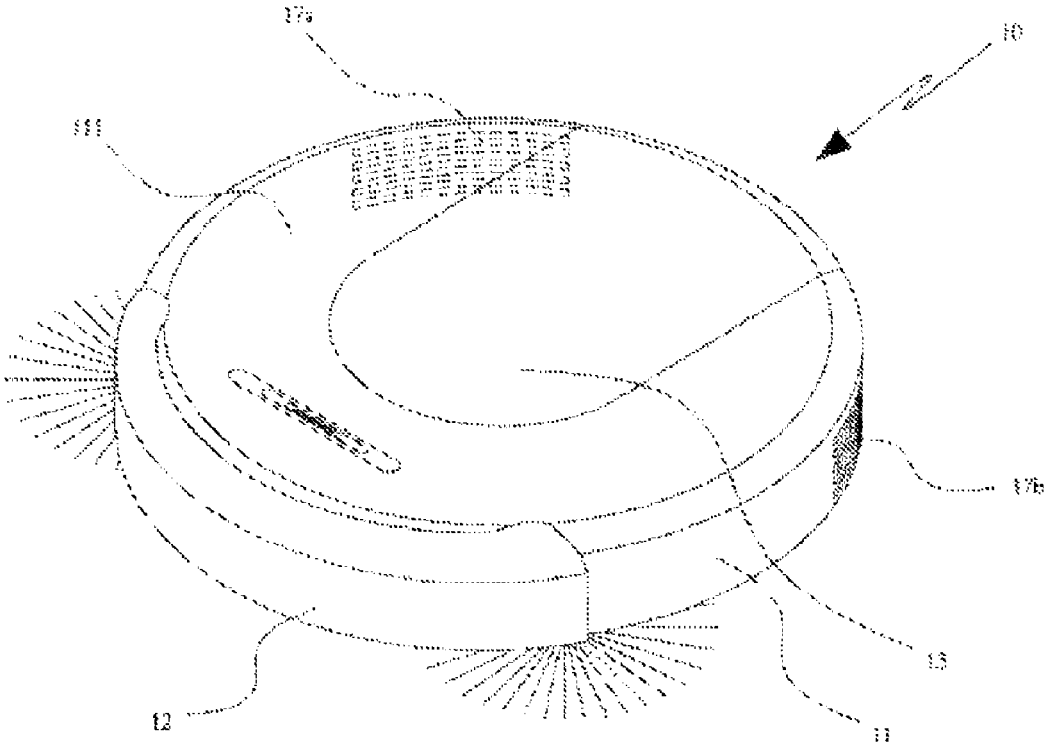
FIG. 1 is an illustration showing a thin-type automatic cleaning device according to one embodiment of the present invention.
Figure 2:
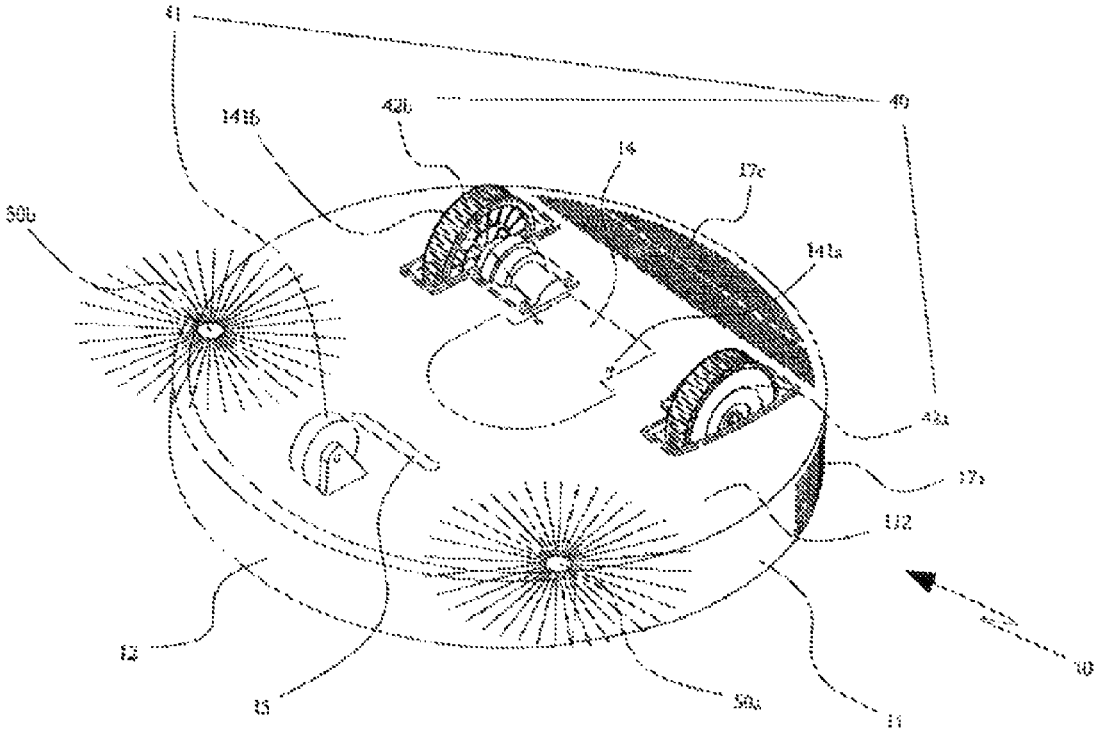
FIG. 2 is an illustration showing a thin-type automatic cleaning device from another perspective view according to one embodiment of the present invention.
Figure 3:
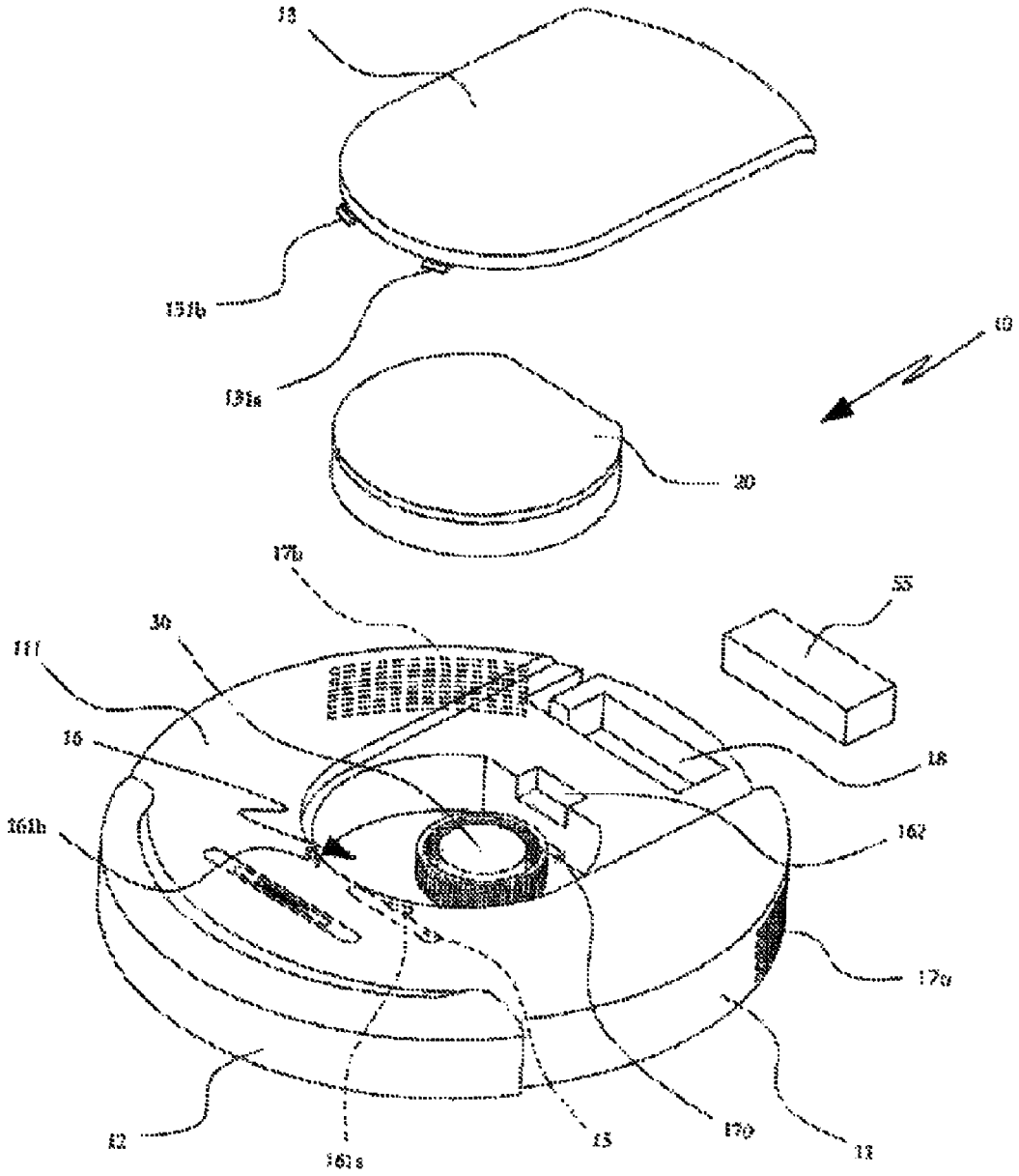
FIG. 3 is an exploded view of a thin-type automatic cleaning device according to one embodiment of the present invention.
Figure 4:
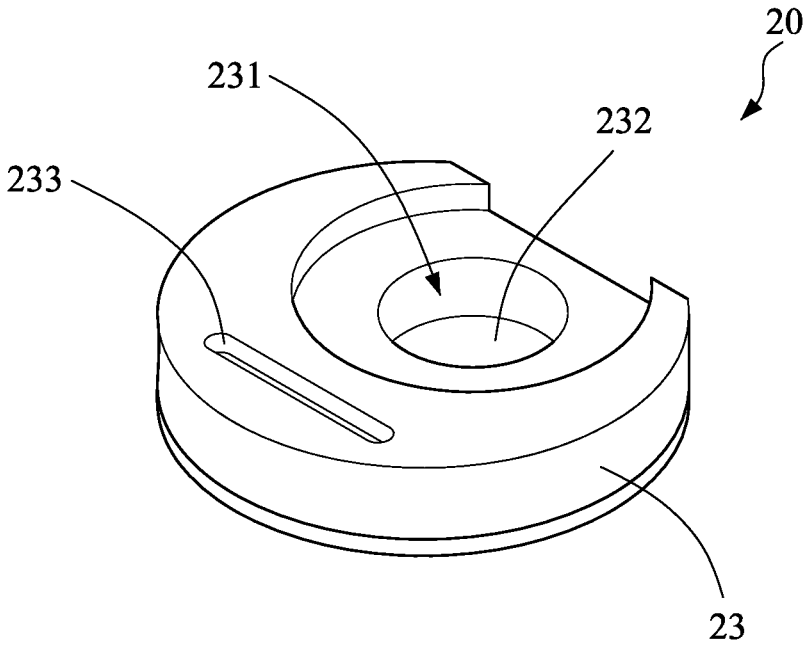
FIG. 4 is a perspective view of the dust collecting box of FIG. 3 from another perspective view.
Figure 5:
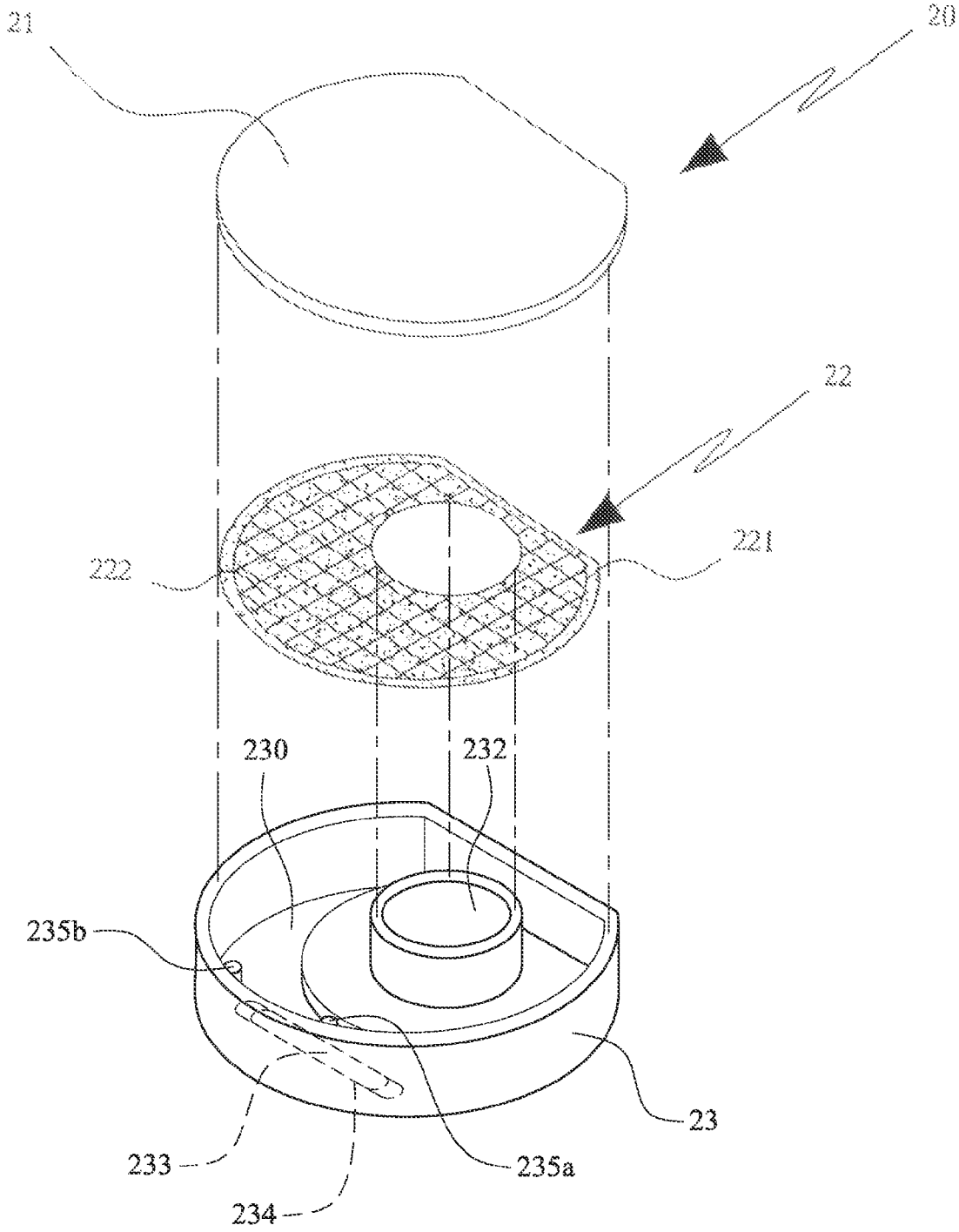
FIG. 5 is an exploded view of the dust collecting box according to the present invention.
Figure 6:
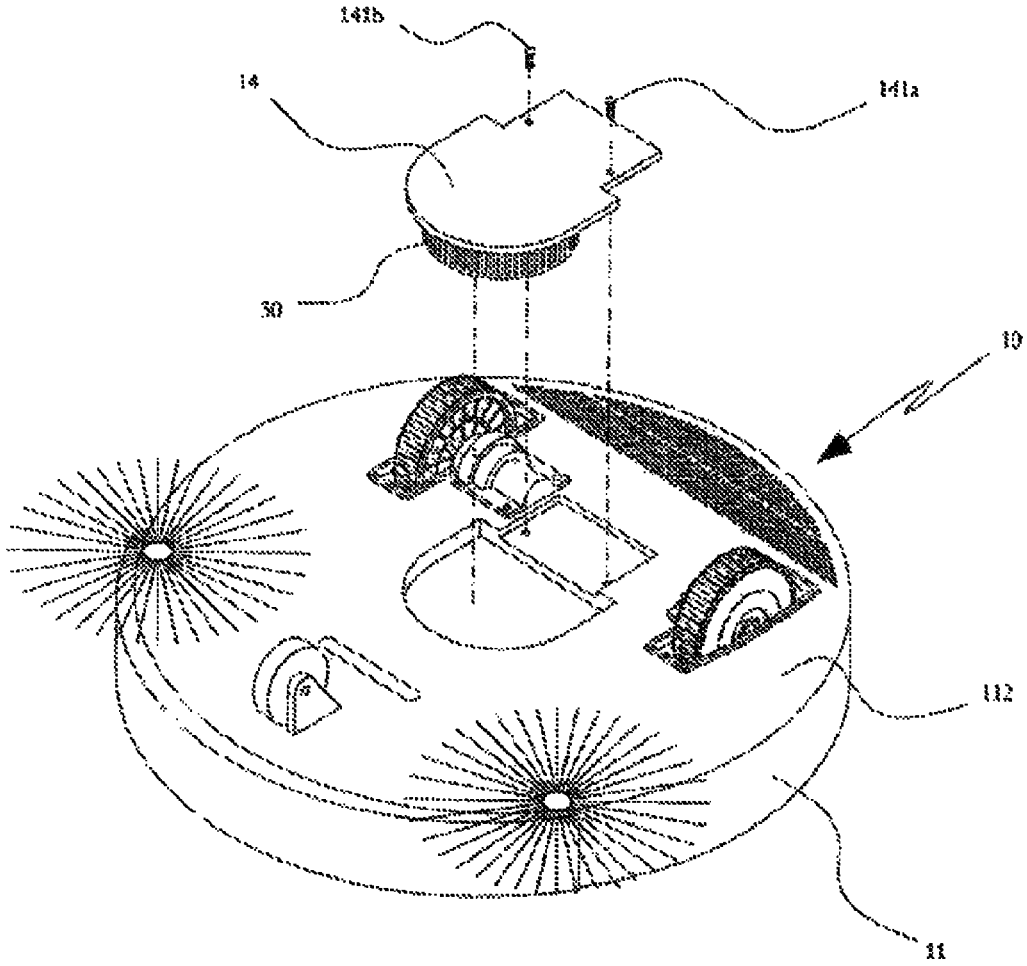
FIG. 6 is another exploded view of a thin-type automatic cleaning device according to a first embodiment.

Please refer to FIGS. 1 to 6, in which FIG. 1 and FIG. 2 show a thin-type automatic cleaning device according to an embodiment of the present invention, FIG. 3 is an exploded view of the embodiment, FIG. 4 is a perspective view of the dust collecting box in FIG. 3 from another perspective view; FIG. 5 is an exploded view of the dust collecting box, and FIG. 6 is another exploded view of the thin-type automatic cleaning device according to the embodiment of the present invention.

As shown, the thin-type automatic cleaning device 10 includes a main body 11 having a shape of a thin disc, a front barrier 12, a dust collecting box 20, a fan module 30, a moving module 40, two rotating side brushes 50*a* and 50*b* and a cell module 55. The front barrier 12 is provided at the front rim of the main body 11 to detect an obstacle on the moving path of the device and to synchronously control the moving mode of the device. The dust collecting box 20 is received within the main body 11 for collecting dust and garbage. The moving module 40 includes a front wheel 41 and two propelling wheels 42*a* and 42*b* exposed externally to the bottom surface 112 of the main body 11. The control processing module controls the function mode for driving the movement of the main body 11. The rotating side brushes 50*a* and 50*b* are disposed on the bottom surface 112 of the main body 11 for assisting the ground cleaning. The cell module 55 is provided within the main body 11 for supplying power to the device.

The main body 11 includes a top lid 13, a bottom lid 14, a placing chamber 16 and a cell chamber 18. The placing chamber 16 is used for receiving the dust collecting box 20 and accommodating the fan module 30. The cell chamber 18 is used for receiving the cell module 55. The top lid 13 is provided to cover on the top side of the placing chamber 16 and the cell chamber 18 as well to seal the top surface 111 of the main body 11. The bottom lid 14 is provided on the bottom side of the placing chamber 16 to seal the bottom surface 112 of the main body 11. The dust vacuuming opening 15 is a slot provided on the bottom surface 112 of the main body 11. The dust vacuuming opening 15 penetrates through the main body 11 from the placing chamber 16. The air exhaustion opening 170 is a slot on the wall of the placing chamber 16. A plurality of air exhaustion openings 17*a*, 17*b* and 17*c* are provided on the rim of the main body 11 for being communicated with the air exhaustion opening 170 so as to form an air exhaustion channel.

The dust collecting box 20 includes an upper casing 21, a lower casing 23 and a partition 22. The partition 22 is provided on the lower casing 23 and is configured with a bracket 221 and a filter net 222, wherein the filter net 222 is all extending in a direction parallel to a bottom surface of the lower casing 23. The upper casing 21 and the lower casing 23 are engaged with each other to form a closed space within the dust collecting box 20. The structure of the dust collecting box 20 generally matches the structure of the placing chamber 16 so that the dust collecting box 20 can be received within the placing chamber 16. The bottom surface of the lower casing 23 protrudes toward the interior to form a receiving cavity 231 which has a side wall and is cylindrical so that the receiving cavity 231 is covering an outer surface of the fan module 30. The structure of the receiving cavity 231 is provided to accommodate the fan module 30. Thus the dust collecting box 20 forms a nested structure with the fan module to reduce the thickness of the thin automated cleaning device.

The details of the dust collecting box 20 are described as follows. An air vacuuming opening 232 of a circular shape is a slot on the top of the receiving cavity 231 of the lower casing 23 and is accurately faced to the fan module 30. The partition 22 is leaned against the periphery of the lower casing 23 and leaned against a circumference of the air vacuuming opening 232. A dust collecting tank 230 which is a generally semi-circular trench is formed within the lower casing 23. A dust collecting opening 233 is an elongate slot and is formed at the bottom of the dust collecting tank 230. The dust collecting opening 233 is faced toward the vacuuming opening 15 at the bottom surface 112 of the main body 11. The air exhaustion opening 232 exhausts the air inside the dust collecting box 20 to make the dust collecting box 20 a vacuum when the fan module 30 is operating. Dust and garbage are vacuumed into the dust collecting tank 230 through the dust vacuuming opening 15. The air flow vacuumed from the dust collecting box 20 by the fan module 30 flows through the partition 22 to filter dust and is exhausted out of the main body 11 from the exhaustion channel formed by the air exhaustion openings 170, 17*a*, 17*b* and 17*c*.

An auxiliary recess 162 is positioned adjacent to the placing chamber 16 on the main body 11. The user can easily take out the dust collecting box 20 to clean. The dust collecting box 20 further includes two columns 235*a* and 235*b* and a barrier plate 234. The barrier plate 234 is oriented by columns 235*a* and 235*b* and is faced to the dust collecting opening 233. The barrier plate 234 lifts upon the air flow, then the dust and garbage may enter into the dust collecting tank 230. When the fan module 30 is closed, the barrier plate 234 covers the dust collecting opening 233 to prevent the dust and garbage from falling to the ground.

Another characteristic of the present invention is that the fan module 30 is disposed on the bottom lid 14. The bottom lid 14 is screwed to the main body 11 by two screws 141*a* and 141*b*. Only the screws 141*a* and 141*b* need to be detached to take out the fan module 30 for maintaining or replacing. It is much easier to maintain the device.

Figure 7:
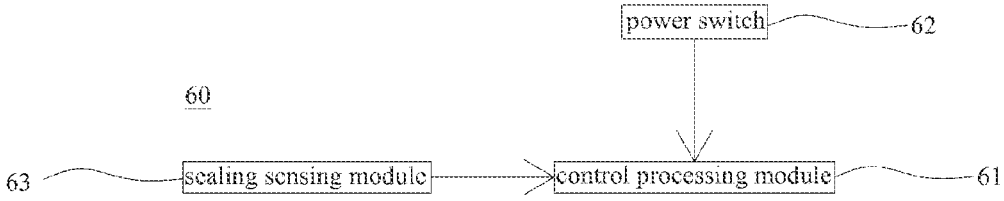
FIG. 7 is a schematic diagram of an activating system of a thin-type automatic cleaning device according to the present invention.

Another characteristic of the present invention is that safety is taken into consideration. Refer to FIG. 7, a schematic diagram of the system architecture of the activating control system of the thin automated cleaning device of the invention is shown. As shown, the activating control system 60 includes a control processing module 61, a power switch 62 and a sealing sensing module 63. The power switch 62 is selectively switched between an on-state and an off-state by external operation. When the power switch 62 is turned to an on-state, an activated signal is transmitted to the control processing module 61 to activate the moving module 40, the fan module 30, etc. The sealing sensing module 63 detects whether or not the top lid 13 is sealed to the top of the placing chamber 16 and transmits a first sensing signal to the control processing module 61. The control processing module 61 determines whether or not to activate the moving module 40, the fan module and other function modules according to the first sensing signal. Only when the top lid 13 is detected as sealed will the control processing module 61 activate various modules. When the top lid 13 is not sealed, the control processing module 61 doesn't activate any module to prevent an operator from contacting components that are under operating and avoid an accidental injury.

In the embodiment, two buckling sections 161*a* and 161*b* are disposed to the upper edge of the placing chamber 16. Two fasteners 131*a* and 131*b* are disposed to the top lid 13. The fasteners are engaged with the buckling sections 161*a* and 161*b* so that the top lid 13 is disposed on the main body 11. In one embodiment, the sealing sensing module 63 may be provided within the buckling sections 161*a* and 161*b* and touching sensor elements such as micro-switches or non-touching sensor elements such as light blocking devices and light reflectors may be used to detect whether the fasteners 131*a* and 131*b* are engaged to the buckling sections 161*a* and 161*b*.

The last point that should be clarified is the description and the drawings emphasize the technical features of the present invention. Other well known details that are not related to the present invention are omitted.

In sum, the dust collecting box and the fan module of the thin-type automatic cleaning device are configured as a nested structure in the present invention to effectively reduce the thickness of the device. The fan module is disposed on the bottom lid to simplify the detaching and maintaining of the fan module. Moreover, the sealing sensing module of the present invention detects whether or not the top lid is sealed to control the activating of the device, thus safety is taken into consideration. Apparently, the automatic cleaning device is more suitable for home demands.

Above detailed description and drawings only describe some preferred embodiments of the present invention but not to limit the present invention. The true scope of the present invention should be defined by appended claims. Any change or modification that is apparent to one person having ordinary skill in the art should fall in the scope of appended claims.

What is claimed is:

1. A thin-type automatic cleaning device including:

a main body comprising a placing chamber;

a centrifugal fan module provided within the placing chamber; and a dust collecting box having an outer surface with a shape corresponding to that of the placing chamber, and the dust collecting box being received within the placing chamber, wherein the dust collecting box comprises a filter net, an upper casing and a lower casing, the upper casing and the lower casing engaged with each other, the filter net is all extending in a direction parallel to a bottom surface of the lower casing, and the lower casing is provided with a receiving cavity and an air vacuuming opening, the receiving cavity having a side wall that is protruding from the box bottom surface toward an interior of the dust collecting so that the receiving cavity is covering an outer surface of the fan module, and the air vacuuming opening, facing toward the fan module, is provided on a top of the receiving cavity the main body further comprises a top lid provided on a top side of the placing chamber, providing access to the placing chamber, and a bottom lid provided on a bottom side of the placing chamber, providing access to the fan module housed within the placing chamber, and the centrifugal fan module is provided on the bottom lid.

2. The thin-type automatic cleaning device according to claim 1, wherein a dust vacuuming opening is provided on a bottom surface of the main body and extends to the placing chamber, a dust collecting opening is provided in the lower casing of the dust collecting box in a position corresponding to the dust vacuuming opening in the main body, and an air exhaustion opening provided at a periphery of the placing chamber extends through the main body.

3. The thin-type automatic cleaning device according to claim 2, wherein the dust collecting box comprises a partition configured by a bracket and the filter net, and the partition is provided in the lower casing to lean against a circumference of the air vacuuming opening.

* * * * *